US010449605B2

(12) United States Patent
Bullied et al.

(10) Patent No.: US 10,449,605 B2
(45) Date of Patent: Oct. 22, 2019

(54) METHOD AND APPARATUS FOR MANUFACTURING A MULTI-ALLOY CAST STRUCTURE

(71) Applicant: United Technologies Corporation, Farmington, CT (US)

(72) Inventors: Steven J. Bullied, Pomfret Center, CT (US); John J. Marcin, Jr., Marlborough, CT (US); Emily K. Kreek, Manchester, CT (US); Carl R. Verner, Windsor, CT (US); Mario P. Bochiechio, Vernon, CT (US)

(73) Assignee: United Technologies Corporation, Farmington, CT (US)

( * ) Notice: Subject to any disclaimer, the term of this patent is extended or adjusted under 35 U.S.C. 154(b) by 753 days.

(21) Appl. No.: 15/036,214

(22) PCT Filed: Nov. 7, 2014

(86) PCT No.: PCT/US2014/064534
§ 371 (c)(1),
(2) Date: May 12, 2016

(87) PCT Pub. No.: WO2015/080854
PCT Pub. Date: Jun. 4, 2015

(65) Prior Publication Data

US 2016/0288201 A1 Oct. 6, 2016

Related U.S. Application Data

(60) Provisional application No. 61/933,789, filed on Jan. 30, 2014, provisional application No. 61/909,668, filed on Nov. 27, 2013.

(51) Int. Cl.
*B22D 19/16* (2006.01)
*B22C 9/24* (2006.01)
(Continued)

(52) U.S. Cl.
CPC ..... *B22D 19/16* (2013.01); *B22C 9/06* (2013.01); *B22C 9/082* (2013.01); *B22C 9/24* (2013.01);
(Continued)

(58) Field of Classification Search
CPC ..... B22D 19/16; B22D 21/005; B22D 25/02; B22C 9/06; B22C 9/082; B22C 9/24;
(Continued)

(56) References Cited

U.S. PATENT DOCUMENTS 3,847,203 A 11/1974 Northwood
3,865,177 A 2/1975 Ahacic et al.
(Continued)

FOREIGN PATENT DOCUMENTS

EP 2210688 A1 7/2010
WO 2014/093826 A2 6/2014
WO 2014133635 A2 9/2014

OTHER PUBLICATIONS

International Search Report and Written Opinion for PCT Patent Application No. PCT/US2014/064534, dated Feb. 17, 2015.
(Continued)

*Primary Examiner* — Kevin P Kerns
*Assistant Examiner* — Steven S Ha
(74) *Attorney, Agent, or Firm* — Bachman & LaPointe, P.C.

(57) ABSTRACT

A method casts a plurality of alloy parts in a mold (600; 700) having a plurality of part-forming cavities (601). The method comprises pouring a first alloy into the mold causing: the first alloy to branch into respective flows along respective first flowpaths (676, 684; 708) to the respective cavities; and a surface of the first alloy in the part-forming cavities to equilibrate. The method further comprises pouring a second alloy into the mold causing: the second alloy to
(Continued)

branch into respective flows along respective second flow-paths (676, 680; 712) to the respective cavities.

25 Claims, 7 Drawing Sheets

(51) Int. Cl.

| | |
|---|---|
| ***B22C 9/06*** | (2006.01) |
| ***B22C 9/08*** | (2006.01) |
| ***B22D 21/00*** | (2006.01) |
| ***B22D 25/02*** | (2006.01) |
| ***F01D 5/14*** | (2006.01) |

(52) U.S. Cl.
CPC ..... *B22D 21/005* (2013.01); *B22D 25/02* (2013.01); *F01D 5/147* (2013.01); *F05D 2230/21* (2013.01)

(58) Field of Classification Search
CPC ..... B22C 7/02; B22C 7/023; B22C 7/026; B22C 9/04; B22C 9/043; B22C 9/08
See application file for complete search history.

(56) References Cited

U.S. PATENT DOCUMENTS

| | | | | |
|---|---|---|---|---|
| 4,133,371 | A | 1/1979 | Birch et al. | |
| 4,673,021 | A | 6/1987 | Graham et al. | |
| 5,000,244 | A | 3/1991 | Osborne | |
| 5,135,041 | A | 8/1992 | Goss | |
| 7,201,212 | B2 | 4/2007 | Bullied et al. | |
| 7,882,885 | B2 * | 2/2011 | Bullied ..... | B22C 9/088 164/122.1 |
| 8,387,678 | B1 | 3/2013 | Park et al. | |
| 2002/0005265 | A1 | 1/2002 | Ford | |
| 2005/0016710 | A1 | 1/2005 | Malterer | |
| 2006/0102311 | A1 | 5/2006 | Howard | |
| 2009/0269193 | A1 | 10/2009 | Larose et al. | |
| 2011/0293431 | A1 | 12/2011 | Harders et al. | |

OTHER PUBLICATIONS

European Search Report dated Jun. 21, 2017 for European Patent Application No. 14865531.9.

* cited by examiner

METHOD AND APPARATUS FOR MANUFACTURING A MULTI-ALLOY CAST STRUCTURE

CROSS-REFERENCE TO RELATED APPLICATIONS

Benefit is claimed of U.S. Patent Application No. 61/909,668, filed Nov. 27, 2013, and entitled "Method and Apparatus for Manufacturing a Multi-Alloy Cast Structure" and U.S. Patent Application No. 61/933,789, filed Jan. 30, 2014, and entitled "Method and Apparatus for Manufacturing a Multi-Alloy Cast Structure", the disclosures of which are incorporated by reference herein in their entireties as if set forth at length.

BACKGROUND OF THE INVENTION

The disclosure relates to casting of aerospace components. More particularly, the disclosure relates to casting of single crystal or directionally solidified castings.

A gas turbine engine typically includes a fan section, a compressor section, a combustor section and a turbine section. Air entering the compressor section is compressed and delivered into the combustor section where it is mixed with fuel and ignited to generate a high-speed exhaust gas flow. The high-speed exhaust gas flow expands through the turbine section to drive the compressor section and the fan section.

In a two-spool engine, the compressor section typically includes low and high pressure compressors, and the turbine section includes low and high pressure turbines.

The high pressure turbine drives the high pressure compressor through an outer shaft to form a high spool, and the low pressure turbine drives the low pressure compressor through an inner shaft to form a low spool. The fan section may also be driven by the low inner shaft. A direct drive gas turbine engine includes a fan section driven by the low spool such that the low pressure compressor, low pressure turbine and fan section rotate at a common speed in a common direction.

A speed reduction device such as an epicyclical gear assembly may be utilized to drive the fan section such that the fan section may rotate at a speed different than the driving turbine section so as to increase the overall propulsive efficiency of the engine. In such engine architectures, a shaft driven by one of the turbine sections provides an input to the epicyclical gear assembly that drives the fan section at a reduced speed such that both the turbine section and the fan section can rotate at closer to optimal speeds.

SUMMARY OF THE INVENTION

One aspect of the disclosure involves a method for casting a plurality of alloy parts in a mold having a plurality of part-forming cavities. The method comprises pouring a first alloy into the mold causing: the first alloy to branch into respective flows along respective first flowpaths to the respective cavities; and a surface of the first alloy in the part-forming cavities to equilibrate. The method further comprises pouring a second alloy into the mold causing: the second alloy to branch into respective flows along respective second flowpaths to the respective cavities.

A further embodiment may additionally and/or alternatively include the causing said surface of the first alloy in the part forming cavities to equilibrate being via a first passageway linking the first flowpaths.

A further embodiment may additionally and/or alternatively include the first passageway comprising a plurality of segments each directly connected to a pair of downsprues.

A further embodiment may additionally and/or alternatively include the first passageway comprising a plurality of segments each directly connected to a pair of grain starters.

A further embodiment may additionally and/or alternatively include the pouring said second alloy into the mold causing a surface of the second alloy in the part-forming cavities to equilibrate via a second passageway linking the second flowpaths.

A further embodiment may additionally and/or alternatively include the first flowpaths and second flowpaths extending from a single pour cone.

A further embodiment may additionally and/or alternatively include each of the first flowpaths being partially overlapping with an associated one of the second flowpaths.

A further embodiment may additionally and/or alternatively include after the equilibrating of the first alloy, but before the pouring of the second alloy, the first alloy along at least portions of the first flowpaths solidifies.

A further embodiment may additionally and/or alternatively include the first alloy and the second alloy being of different composition.

A further embodiment may additionally and/or alternatively include pouring a third alloy into the mold.

A further embodiment may additionally and/or alternatively include the first flowpaths and second flowpaths extending from first ports on a pour cone and third flowpaths extending from second ports on the pour cone.

A further embodiment may additionally and/or alternatively include the alloy parts being turbine engine blades.

A further embodiment may additionally and/or alternatively include the first alloy and the second alloy being nickel- and/or cobalt-based superalloys.

A further embodiment may additionally and/or alternatively include the pour cone being a dual concentric pour cone having an inner pour cone and an outer pour cone. The first ports are on one of the inner pour cone and the outer pour cone and the second ports are on the other of the inner pour cone and outer pour cone.

Another aspect of the disclosure involves a casting mold comprising: a plurality of part-forming cavities, each having a lower end and an upper end; a pour cone; a plurality of first feeder passageway sections extending to associated first ports on respective associated said cavities; a first passageway connecting the part forming cavities at a height below tops of the part-forming cavities; a plurality of second feeder passageway sections extending to associated second ports on respective associated said cavities, the second ports being higher than the first ports.

A further embodiment may additionally and/or alternatively include the first passageway connecting the part forming cavities via the first feeder passageway sections.

A further embodiment may additionally and/or alternatively include a second passageway and connecting the second feeder passageway sections.

A further embodiment may additionally and/or alternatively include the first feeder passageway sections and the second feeder passageway sections branching from trunk passageway sections extending downward from the pour cone.

A further embodiment may additionally and/or alternatively include the first passageway being below the second passageway.

A further embodiment may additionally and/or alternatively include a plurality of third feeder passageway sections extending to associated third ports on respective associated said cavities.

A further embodiment may additionally and/or alternatively include the third ports being above the second ports.

A further embodiment may additionally and/or alternatively include: first flowpaths through the first feeder passageway sections to the first ports and second flowpaths through the second feeder passageway sections to the second ports extending from a first ports on the pour cone; and third flowpaths through the third feeder passageway sections to the third ports extending from second ports on the pour cone.

A further embodiment may additionally and/or alternatively include a first passageway comprising the first feeder passageway sections and a second passageway comprising the second feeder passageway sections extending fully around a central vertical axis of the mold.

A further embodiment may additionally and/or alternatively include 3-40 said cavities.

A further embodiment may additionally and/or alternatively include the cavities being blade-shaped.

A further embodiment may additionally and/or alternatively include one or both of: the cavities having seeds; and the cavities comprising helical grain starter passageways.

The details of one or more embodiments are set forth in the accompanying drawings and the description below. Other features, objects, and advantages will be apparent from the description and drawings, and from the claims.

BRIEF DESCRIPTION OF THE DRAWINGS

Like reference numbers and designations in the various drawings indicate like elements.

DETAILED DESCRIPTION

U.S. Patent Application Ser. No. 61/794,519, filed Mar. 15, 2013 and entitled "Multi-Shot Casting" (the '519 application) and International Application No. PCT/US2013/075017, filed Dec. 13, 2013 and entitled "Multi-Shot Casting" (the '017 application), the disclosures of which are incorporated in their entireties herein by reference as if set forth at length, disclose multi-shot cast articles, alloys and alloy combinations for such articles, molds for casting such articles, and methods for casting such articles. The compositions of Table 1 below are drawn from those of the '519 application and '017 application.

Figure 1:
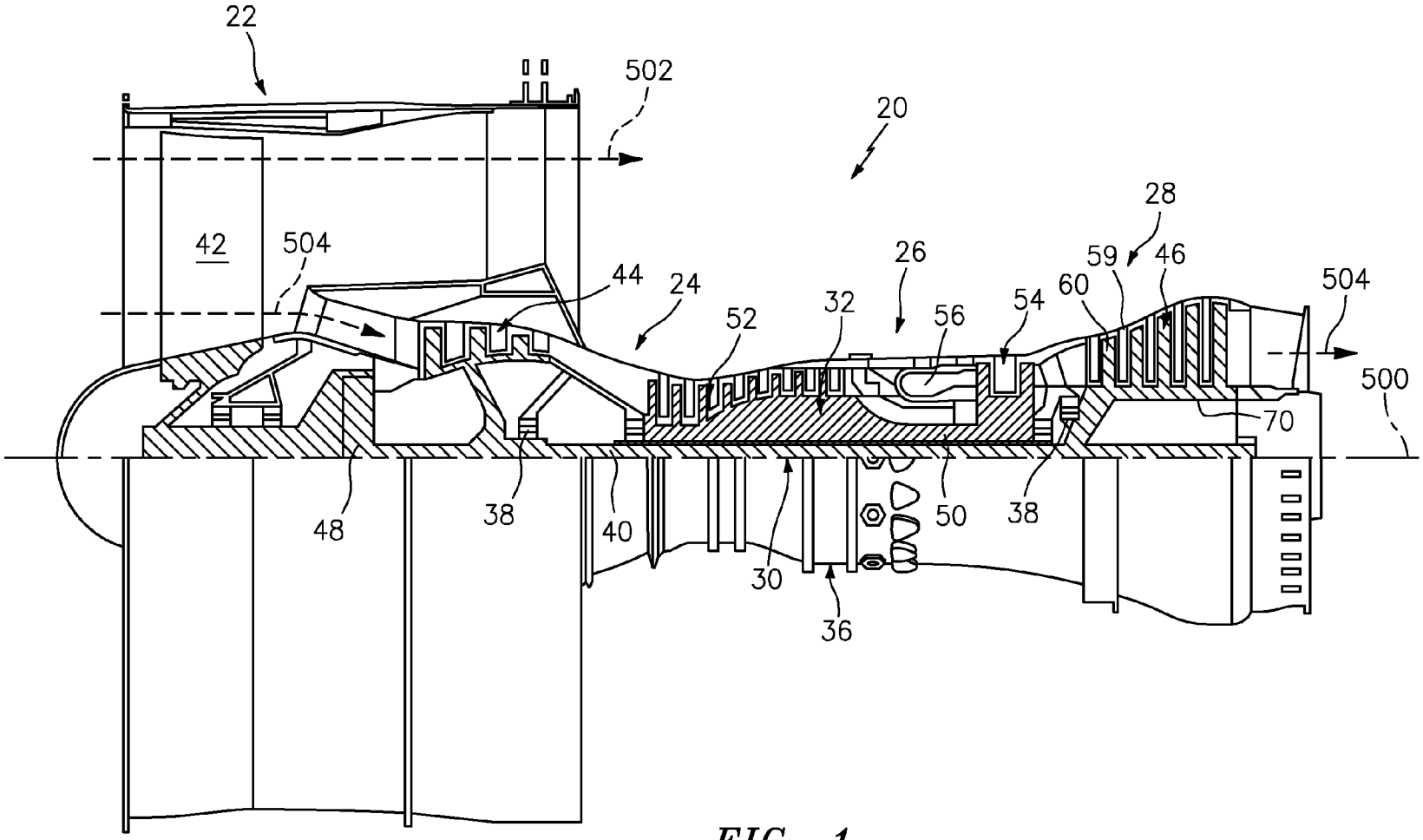
FIG. 1 is a FIG. 1 is a partially schematic half-sectional view of a gas turbine engine.

FIG. 1 schematically illustrates a gas turbine engine 20. The exemplary gas turbine engine 20 is a two-spool turbofan having a centerline (central longitudinal axis) 500, a fan section 22, a compressor section 24, a combustor section 26 and a turbine section 28. Alternative engines might include an augmentor section (not shown) among other systems or features. The fan section 22 drives air along a bypass flowpath 502 while the compressor section 24 drives air along a core flowpath 504 for compression and communication into the combustor section 26 then expansion through the turbine section 28. Although depicted as a turbofan gas turbine engine in the disclosed non-limiting embodiment, it is to be understood that the concepts described herein are not limited to use with turbofan engines and the teachings can be applied to non-engine components or other types of turbomachines, including three-spool architectures and turbine engines that do not have a fan section.

The engine 20 includes a first spool 30 and a second spool 32 mounted for rotation about the centerline 500 relative to an engine static structure 36 via several bearing systems 38. It should be understood that various bearing systems 38 at various locations may alternatively or additionally be provided.

The first spool 30 includes a first shaft 40 that interconnects a fan 42, a first compressor 44 and a first turbine 46. The first shaft 40 is connected to the fan 42 through a gear assembly of a fan drive gear system (transmission) 48 to drive the fan 42 at a lower speed than the first spool 30. The second spool 32 includes a second shaft 50 that interconnects a second compressor 52 and second turbine 54. The first spool 30 runs at a relatively lower pressure than the second spool 32. It is to be understood that "low pressure" and "high pressure" or variations thereof as used herein are relative terms indicating that the high pressure is greater than the low pressure. A combustor 56 (e.g., an annular combustor) is between the second compressor 52 and the second turbine 54 along the core flowpath. The first shaft 40 and the second shaft 50 are concentric and rotate via bearing systems 38 about the centerline 500.

The core airflow is compressed by the first compressor 44 then the second compressor 52, mixed and burned with fuel in the combustor 56, then expanded over the second turbine 54 and first turbine 46. The first turbine 46 and the second turbine 54 rotationally drive, respectively, the first spool 30 and the second spool 32 in response to the expansion.

Figure 2:
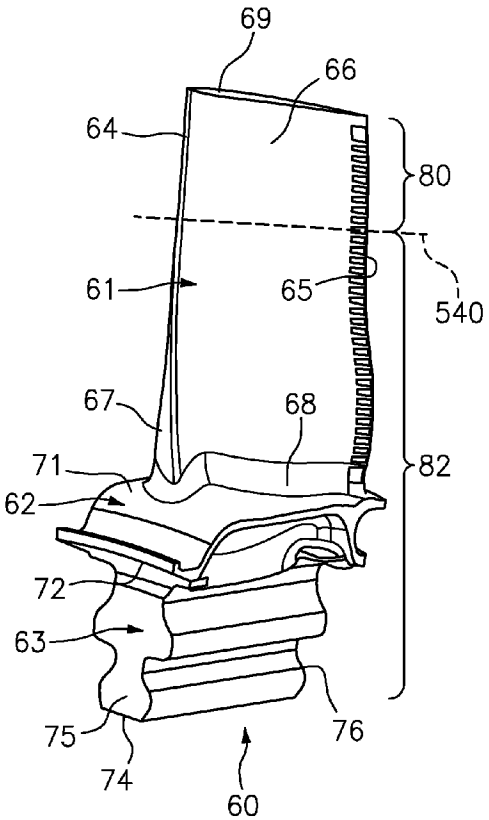
FIG. 2 is a view of a turbine blade of the engine of FIG. 1.

The engine 20 includes many components that are or can be fabricated of metallic materials, such as aluminum alloys and superalloys. As an example, the engine 20 includes rotatable blades 60 and static vanes 59 in the turbine section 28. The blades 60 and vanes 59 can be fabricated of superalloy materials, such as cobalt- or nickel-based alloys. The blade 60 (FIG. 2) includes an airfoil 61 that projects outwardly from a platform 62. A root portion 63 (e.g., having a "fir tree" profile) extends inwardly from the platform 62 and serves as an attachment for mounting the blade in a complementary slot on a disk 70 (shown schematically in FIG. 1). The airfoil 61 extends streamwise from a leading edge 64 to a trailing edge 65 and has a pressure side 66 and a suction side 67. The airfoil extends spanwise from an inboard end 68 at the outer diameter (OD) surface 71 of the platform 62 to a distal/outboard en 69 (shown as a free tip rather than a shrouded tip in this example).

The root 63 extends from an outboard end at an underside 72 of the platform to an inboard end 74 and has a forward face 75 and an aft face 76 which align with corresponding faces of the disk when installed.

The blade 60 has a body or substrate that has a hybrid composition and microstructure. For example, a "body" is a main or central foundational part, distinct from subordinate features, such as coatings or the like that are supported by the underlying body and depend primarily on the shape of the underlying body for their own shape. As can be appreciated however, although the examples and potential benefits may be described herein with respect to the blades 60, the examples can also be extended to the vanes 59, disk 70, other rotatable metallic components of the engine 20, non-rotatable metallic components of the engine 20, or metallic non-engine components.

The blade 60 has a tipward first section 80 fabricated of a first material and a rootward second section 82 fabricated of a second, different material. A boundary between the sections is shown as 540. For example, the first and second materials differ in at least one of composition, microstructure and mechanical properties. In a further example, the first and second materials differ in at least density. In one example, the first material (near the tip of the blade 60) has a relatively low density and the second material has a relatively higher density. The first and second materials can additionally or alternatively differ in other characteristics, such as corrosion resistance, strength, creep resistance, fatigue resistance or the like.

In this example, the sections 80/82 each include portions of the airfoil 61. Alternatively, or in addition to the sections 80/82, the blade 60 can have other sections, such as the platform 62 and the root potion 63, which may be independently fabricated of third or further materials that differ in at least one of composition, microstructure and mechanical properties from each other and, optionally, also differ from the sections 80/82 in at least one of composition, microstructure, and mechanical properties.

In this example, the airfoil 61 extends over a span from 0% span at the platform 62 to 100% span at the tip 69. The section 82 extends from the 0% span to X % span (at boundary 540) and the section 80 extends from the X % span to the 100% span. In one example, the X % span is, or is approximately, 70% such that the section 80 extends from 70% to 100% span. In other examples, the X % can be anywhere from 1%-99%. In a further example, the densities of the first and second materials differ by at least 3%. In a further example, the densities differ by at least 6%, and in one example differ by 6%-10%. As is discussed further below, the X % span location and boundary 540 may represent the center of a short transition region between sections of the two pure first and second materials.

The first and second materials of the respective sections 80/82 can be selected to locally tailor the performance of the blade 60. For example, the first and second materials can be selected according to local conditions and requirements for corrosion resistance, strength, creep resistance, fatigue resistance or the like. Further, various benefits can be achieved by locally tailoring the materials. For instance, depending on a desired purpose or objective, the materials can be tailored to reduce cost, to enhance performance, to reduce weight or a combination thereof.

In one example, the blade 60, or other hybrid component, is fabricated using a casting process. For example, the casting process can be an investment casting process that is used to cast a single crystal microstructure (with no high angle boundaries), a directional (columnar grain) microstructure or an equiaxed microstructure. In one example of fabricating the blade 60 by casting, the casting process introduces two, or more, alloys that correspond to the first and second (or more) materials. For example, the alloys are poured into an investment casting mold at different stages in the cooling cycle to form the sections 80/82 of the blade 60. The following example is based on a directionally solidified, single crystal casting technique to fabricate a nickel-based blade, but can also be applied to other casting techniques, other material compositions, and other components.

At least two nickel-based alloys of different composition (and different density upon cooling) are poured into an investment casting mold at different stages of the withdrawal and solidification process of the casting. For instance, in a tip-upward casting example of the blade 60, the alloy corresponding to the second material is poured into the mold to form the root 63, the platform 62 and the airfoil portion of second section 82. As the mold is withdrawn from the heating chamber, the alloy in the root 63 begins to solidify. With further withdrawal, a solidification front moves upwards (in this example) toward the platform 62 and airfoil portion of the second section 82. Prior to complete solidification of the alloy at the top of the second section 82, another alloy corresponding to the first material of the first section 80 is poured into the mold. The additional alloy mixes in a liquid state with the still liquid alloy at the top of the second section 82. As the solidification front continues upwards, the two mixed alloys solidify in a boundary portion (zone) between the sections 80/82. As additional alloy of the first material is poured into the mold, the boundary zone transitions to fully being alloy of the first material as the first section 80 solidifies. Thus, the boundary zone provides a strong metallurgical bond between the two alloys of the sections 80/82 from the mixing of the alloys in the liquid state, and thus does not have some of the drawbacks of solid-state bonds (e.g., solid state bonds providing locations for crack initiation.

In single crystal investment castings, a seed of one alloy can be used to preferentially orient a compositionally different casting alloy. Furthermore, nickel-based alloy coatings strongly bond to nickel-based alloy substrates of different composition. The seeding and bonding suggests that the approach of multi-material casting with the metallurgical bond of the boundary zone is feasible to produce a strong bond.

Additionally, lattice parameters and thermal expansion mismatches between different composition nickel-based alloys are relatively insignificant, which suggests that the boundary between the sections 80/82 is unlikely to be a detrimental structural anomaly. Also, for nickel-based alloys, unless such boundary zones are subjected to temperatures in excess of 2000° F. (1093° C.) for substantial periods of time, it is unlikely that the compositions and microstructural stability in the boundary zone will be significantly compromised. Alternatively, the alloys can be selected to reduce or mitigate any such effects to meet engineering requirements. As can be further appreciated, the same approach can be applied to conventionally cast components with equiaxed grain structure, as well directionally solidified castings with columnar grain structure.

For a rotatable component, such as the blade 60 or disk 70, the centrifugal pull at any location is proportional to the product of mass, radial distance from the center and square of the angular velocity (proportional to revolutions per minute). Thus, the mass at the tip has a greater pull than the mass near the attachment location. By the same token, the strength requirement near to the rotational axis is much higher than the strength requirement near the tip. Therefore, the blade 60 having the first section 80 fabricated of a relatively low density material (near the tip) can be beneficial, even if the selected material of the first section 80 does not have the same strength capability as the material selected for the second section 82.

Also, the radial pull is significantly higher than the pressure load experienced by the blade 60 along the engine central axis 500. This suggests that the blade 60, with a low-density/low-strength alloy at the tip, would be greatly beneficial to the engine 20 by either improving engine efficiency or by modifying blade geometry for a longer or broader blade or by reducing the pull on the disk 70 and reducing the engine weight, as well as shrinking the bore of the disk 70 axially, thereby improving the engine architecture.

Similarly, in some embodiments, it can be beneficial to fabricate the root 63 of the blade 60 with a more corrosion resistant and stress corrosion resistant (SCC) alloy and to fabricate the airfoil 61 (or portions thereof) with a more creep resistant alloy. Given that not all engineering properties are required to the same extent at different locations in a component, the weight, cost, and performance of a component, such as the blade 60, can be locally tailored to thereby improve the performance of the engine 20.

The examples herein may be used to achieve various purposes, such as but not limited to, (1) light weight components such as blades, vanes, seals etc., (2) blades with light weight tip and/or shroud, thereby reducing the pull on the blade root attachment and rotating disk, (3) longer or wider blades improving engine efficiency, rather than reducing the weight, (4) corrosion and SCC-resistant roots with creep resistant airfoils, (5) root attachments with high tensile and low cycle fatigue strength and airfoils with high creep resistance, (6) reduced use of high cost elements such as Re in the root portion 63 or other locations, and (7) reduction in investment core and shell reactions with active elements in one or more of the zones. An example of the last purpose involves a situation where more of a particular element is desired in one zone than in another zone. For example in a blade it may be desired to have more of certain reactive elements (e.g., that contribute to oxidation resistance) in the airfoil (or other tipward zone) than in the root (or other rootward zone). In a single-pour tip-downward casting, the alloy will have a greater time in the molten state as one progresses from tip to root. There will be more time for the reactive elements to react with core and shell near the root. Although this can yield acceptable amounts of those reactive elements in the blade, the reaction can degrade the interface between casting and core/shell. The reactions may alter local core/shell compositions so as to make it difficult to leach the core. Thus, the later pour (forming the root in this example) may be of an alloy having relatively low (or none) concentrations of the reactive elements.

Additionally, in some embodiments, the examples herein provide the ability to enhance performance without using costly ceramic matrix composite materials. The examples herein can also be used to change or expand the blade geometry, which is otherwise limited by the blade pull, disk strength and space availability. Furthermore, the examples expand the operating envelope of the geared architecture of the engine 20, where higher rotational speeds of the hot, turbine section 20 are feasible since the rotational speed of the turbine section 28 is not necessarily constrained by the rotational speed of the fan 42 because the fan speed can be adjusted through the gear ratio of the gear assembly 48.

Typically a single crystal nickel-base superalloy component, such as a turbine blade may be cast as follows. A ceramic and/or a refractory metal core or assembly is made, which will ultimately define the internal hollow passages in the turbine blade. Using a die, wax is injected around the core to form a pattern which will eventually define the external shape of the blade. The solid wax with embedded core assembly (and optionally with other wax gating components or additional patterns attached) is then dipped in ceramic slurry to form the outer shell mold. Once the shell is dried, the wax is melted and drained out leaving behind a hollow cavity between the outer shell and the inner core. The assembly is then fired to harden the shell (mold).

Such a mold assembly (typically with a feed tube (e.g. a downsprue for bottom fill shells) and a pour cup) is then placed on a water-cooled chill plate inside an induction heated furnace, enclosed in a vacuum chamber. These features (tube, downsprue, pour cup) may be formed by shelling wax pattern elements either with or separately from the shelling of the blade patterns.

If the alloy is to be cast with the naturally favored <100> orientation along the long axis of the blade (the spanwise direction), the shell may include means such as a hollow helical passage joined to a hollow cavity at the bottom, to form a starter block (grain starter). Wax forming the helix and block may be molded as part of the pattern or secured thereto prior to shelling.

If it is desired to cast the alloy with controlled crystal orientation, then the hollow cavity below the helical passage may be filled with a block of solid single crystal of the desired orientation. This solid block is referred to as a seed. This seed need not be parallel to the axis of the blade. It may be tilted at a desired angle. That provides flexibility in selecting the starting seed and the desired orientation of the casting.

If the mold assembly were to be grown naturally with no seed, then a molten metal charge is melted in the melt cup and poured through the pour cup to fill the mold. The mold can be top fed or bottom fed. A filter may be used in the feed tube to capture any ceramic or solid inclusion in the liquid metal as shown. Once the mold is filled, the radiation from the susceptors heated by the induction coils keep the metal molten. Subsequently the mold is withdrawn from the furnace past/through the baffle which isolates the hot zone of the furnace from the cold zone below. Typically the withdrawal rate is 1-20 inches/hour (2.5 mm/hour to 0.5 m/hour), depending on the complexity and size of the part. The part of the mold that gets withdrawn below the baffle starts solidifying due to the rapid cooling from the chill plate. Because that solidification is largely due to heat transfer through the chill plate it is highly biased in the direction of withdrawal. That is why the process is called directional solidification. Due to directional solidification, the starter block forms columns of grain of crystal of which the helical passage allows only one to survive. This results in a single crystal casting with <100> crystallographic or cube direction parallel to the blade axis.

If the mold is designed to be started with a seed, then it may be positioned in such a way that a portion (e.g., half) of the seed is below the baffle. Now when the molten metal is poured, the half of the seed above the baffle melts and mixes with the new metal. Soon after this occurs, the mold is withdrawn as described above. In this case however, the metal cast in the mold becomes single crystal with the orientation defined by the seed.

According to the present disclosure, a compositional variation may be imposed along the blade. This may entail two or more zones with transitions in between.

An exemplary two-zone blade involves a transition at a location along the airfoil.

For example, an inboard region of the airfoil is under centrifugal load from the portion outboard thereof (e.g., including any shroud). Reducing density of the outboard portion reduces this loading and is possible because the outboard portion may be subject to lower loading (thus allowing the outboard portion to be made of an alloy weaker in creep). An exemplary transition location may be between 30% and 80% span, more particularly 50-75% or 60-75% or an exemplary 70%.

To create such compositional zones, the mold cavity may be filled with a given alloy to a desired intermediate height determined by the design requirement.

In a tip-downward casting example, a low density first alloy will be poured just sufficient to fill the outboard portion, and withdrawal process begins. As the transition location in the cavity approaches the baffle, a second alloy with higher creep strength is poured to fill the rest of the mold. This may be achieved by adding ingot(s) of the second alloy in the melt crucible and pouring the molten second alloy into the pour cup.

Both the withdrawal process and the second pouring may be coordinated in such a way that minimal mixing of the alloys occurs so that large composition gradients between essentially pure bodies of the two alloys are brief (e.g., less than 10% span or less than 5% span).

It is possible the first alloy may be completely solidified before adding the second alloy, but mixing may occur with just sufficient remaining initial alloy in the liquid state to provide a robust transition to the second alloy. Similarly, multiple pours of a given alloy are possible (e.g., splitting the pouring of the second alloy into two pours after the pour of the first alloy such that a first pour of the second alloy forms a transition region with remaining molten first alloy is allowed to partially or fully solidify before a second pour of the second alloy is made).

Various modifications and optimizations may be made. If needed such a process may also benefit with the addition of deoxidizing elements like Ca, Mg, and similar active elements. However, an exemplary approach is to avoid that to provide clean practice and process control.

The procedure described above can be practiced with multiple alloys and any section of the casting desired. It is understood that where one wants the transition between two or more alloys to take place depends on the optimized design and desired performance of the particular components. This is controlled by yield strength, fatigue strength, creep strength, as well as desired oxidation resistance and corrosion resistance of the alloy candidate(s) chosen. The key physical basis to be recognized is that the epitaxial crystallographic relationship is maintained when casting alloys within the class of FCC solid solution hardened and precipitation hardened nickel base alloys used for blades and other gas turbine engine and industrial engine components.

If the second nickel base alloy is a typical coating-type composition with high concentration of aluminum, having a mix of face centered cubic, and body centered cubic or simple cubic or B2 structure, this approach will also work. Such a combination may be desirable in case one wants the latter alloy to be oxidation resistant or have a higher thermal conductivity. In such a situation, epitaxial relationship is not expected but interfacial bond may be acceptable as formed in liquid state or by inter-diffusion.

The foregoing discusses a method for making multi-alloy single-crystal castings. However, a similar method may provide a low cost columnar grain structure. In such case the casting may still be carried out by directional solidification but no helical passage is used to filter out only one grain. Instead, multiple of columnar grains are allowed to run through the casting.

Figure 3:
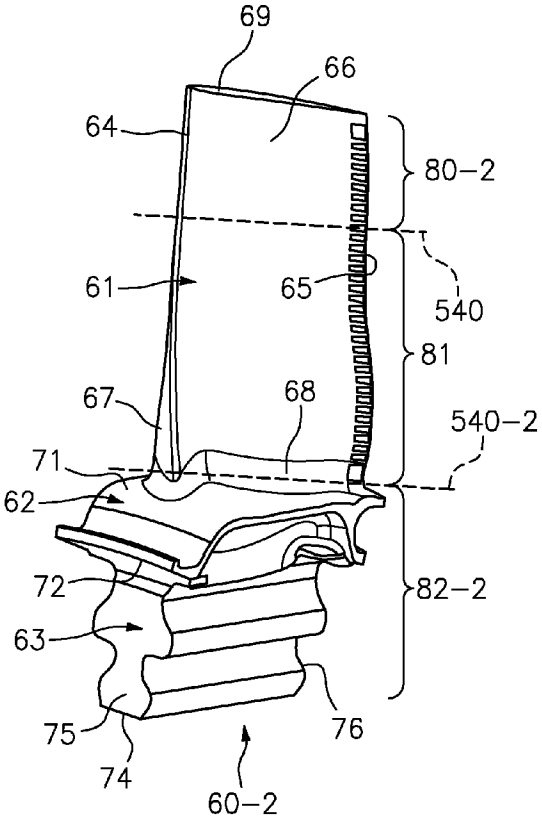
FIG. 3 is a view of an alternative turbine blade of the engine of FIG. 1.

FIG. 3 divides the blade 60-2 into three zones (a tipward Zone 1 numbered 80-2; a rootward Zone 2 numbered 82-2; and an intermediate Zone 3 numbered 81) which may be of two or three different alloys (plus transitions). Desired relative alloy properties for each zone are:

Zone 1 Airfoil Tip: low density (desirable because this zone imposes centrifugal loads on the other zones) and high oxidation resistance. This may also include a tip shroud (not shown);

Zone 2 Root & Fir Tree: high notched LCF strength, high stress corrosion cracking (SCC) resistance, low density (low density being desirable because these areas provide a large fraction of total mass);

Zone 3 Lower Airfoil: high creep strength (due to supporting centrifugal loads with a small cross-section), high oxidation resistance (due to gaspath exposure and heating), higher thermal-mechanical fatigue (TMF) capability/life.

Exemplary Zone 1/3 transition 540 is at 50-80% airfoil span, more particularly 55-75% or 60-70% (e.g., measured at the center of the airfoil section or at half chord). Exemplary Zone 2/3 transition 540-2 is at about 0% span (e.g., −5% to 5% or −10% to 10%).

Table I (divided into Tables IA and IB) shows compositions of three groups of alloys which may be used in various combinations of a two-zone or three-zone blade. Relative to the other groups, general relative properties are:

Group A: high creep strength & oxidation resistance;

Group B: low density and good oxidation resistance; and

Group C: high attachment LCF strength and stress corrosion cracking (SCC) resistance.

TABLE IA

| | | Composition, Weight % | | | | | | | | | | | | |
|---|---|---|---|---|---|---|---|---|---|---|---|---|---|---|
| Alloy | Alloy Group | Cr | Ti | Mo | W | Ta | Other | Al | Co | Re | Ru | Hf | C | Y |
| PWA 1484 | A | 5 | | 1.9 | 5.9 | 8.7 | | 5.65 | 10 | 3 | | 0.1 | | |
| PWA 1487 | | 5 | | 1.9 | 5.9 | 8.7 | | 5.65 | 10 | 3 | | 0.35 | | 0.01 |
| PWA 1497 | | 2 | | 1.8 | 6 | 8.25 | | 5.65 | 16.5 | 6 | 3 | 0.15 | 0.05 | |
| Rene N5 | | 7 | | 1.5 | 5 | 6.5 | | 6.2 | 7.5 | 3 | | 0.15 | | 0.01 |
| Rene N6 | | 4 | | 1 | 6 | 7 | | 5.8 | 12 | 5 | | 0.2 | | |
| CMSX-4 | | 6.5 | 1 | 0.6 | 6 | 6.5 | | 5.6 | 9 | 3 | | 0.1 | | |
| PWA 1430 | | 3.75 | | 1.9 | 8.9 | 8.7 | | 5.85 | 12.5 | 0 | | 0.3 | | |
| Rene N500 | | 6 | | 2 | 6 | 6.5 | | 6.2 | 7.5 | 0 | | 0.6 | | |
| Rene N515 | | 6 | | 2 | 6 | 6.5 | | 6.2 | 7.5 | 1.5 | | 0.38 | | |
| TMS-138A | | 3.2 | | 2.8 | 5.6 | 5.6 | | 5.7 | 5.8 | 5.8 | 3.6 | 0.1 | | |
| TMS-196 | | 4.6 | | 2.4 | 5 | 5.6 | | 5.6 | 5.6 | 6.4 | 5 | 0.1 | | |
| TMS-238 | | 4.6 | | 1.1 | 4 | 7.6 | | 5.9 | 6.5 | 6.4 | 5 | 0.1 | | |
| CMSX-10 | | 2 | 0.2 | 0.4 | 5 | 8 | 0.05Nb | 5.7 | 3 | 6 | | 0.1 | | |
| CM 186LC | | 6 | 0.7 | 0.5 | 8 | 3 | | 5.7 | 9 | 3 | | 1.4 | 0.07 | |
| CMSX-486 | | 5 | 0.7 | 0.7 | 9 | 4.5 | | 5.7 | 9 | 3 | | 1 | 0.07 | |

TABLE IA-continued

| Alloy | Alloy Group | Cr | Ti | Mo | W | Ta | Other | Al | Co | Re | Ru | Hf | C | Y |
|---|---|---|---|---|---|---|---|---|---|---|---|---|---|---|
| | | Composition, Weight % | | | | | | | | | | | | |
| CMSX-7 | | 6 | 0.8 | 0.6 | 9 | 9 | | 5.7 | 10 | 0 | | 0.3 | | |
| CMSX-8 | | 5.4 | 0.7 | 0.6 | 8 | 8 | | 5.7 | 10 | 1.5 | | 0.3 | | |
| LDSX-B | | 8 | | 1.1 | 2 | 4 | | 6.2 | 12.5 | 5 | 2 | 0.1 | | |

TABLE IB

| Alloy | Alloy Group | Cr | Ti | Mo | W | Ta | Other | Al | Co | Re | Ru | Hf | C | Y |
|---|---|---|---|---|---|---|---|---|---|---|---|---|---|---|
| | | Composition, Weight % | | | | | | | | | | | | |
| CMSX-6 | B | 10 | 4.7 | 3 | | 2 | | 4.8 | 5 | | | 0.1 | | |
| Y-1715 GE | | 13 | | | 3.8 | 4.9 | | 6.6 | 7.5 | 1.6 | | 0.14 | 0.04 | |
| LEK-94 | | 6.1 | 1 | 2 | 3.4 | 2.3 | | 6.6 | 7.5 | 2.5 | | 0.1 | | |
| RR-2000 | | 10 | 4 | 3 | | | 1.0V | 5.5 | 15 | | | | | |
| AM 3 | | 8 | 2 | 2 | 5 | 4 | | 6 | 6 | | | | | |
| LDSX-B | | 8 | | 1.1 | 2 | 4 | | 6.2 | 12.5 | 5 | 2 | 0.1 | | |
| LDSX-D | | 6 | | 2 | 4 | 4 | | 6.2 | 12.5 | 5 | 2 | 0.1 | | |
| New 1 | | 5 | | 1 | 3 | 2 | | 6 | 5 | | | 0.1 | | |
| New 2 | | 5 | | 1 | 3 | 2 | | 6.5 | 5 | 3 | | 0.1 | | |
| New 3 | | 8 | | 1 | 3 | 2 | | 6.5 | 5 | | | 0.1 | | |
| New 4 | | 8 | | 1 | 3 | 2 | | 6.5 | 5 | 3 | | 0.1 | | |
| PWA 1480 | C | 10 | 1.5 | | 4 | 12 | | 5 | 5 | | | | | |
| PWA 1440 | | 10 | 1.5 | | 4 | 12 | | 5 | 5 | | | 0.35 | | |
| PWA 1483 | | 12.2 | 4.1 | 1.9 | 3.8 | 5 | | 3.6 | 9 | | | | 0.07 | |
| CMSX-2 | | 8 | 1 | 0.6 | 8 | 6 | | 5.6 | 5 | | | | | |

An exemplary two-alloy blade involves a Group A alloy inboard (e.g. along at least part and more particularly all of the root, e.g., in zones 81 and 82-2 or zone 82) and a Group B alloy along at least part of the airfoil (e.g., a portion extending inward from the tip such as zone 80-2 or zone 80). Suitable two-shot examples selected from these three groups are given immediately below followed by a three shot example.

Another exemplary two-alloy blade involves a Group A along all or most of the airfoil (e.g., tip inward such as zones 80-2 and 81 or zone 80) and a Group C alloy along at least part of the root (e.g., a root majority or zone 82-2 or zone 82).

An exemplary three-alloy blade involves a Group C alloy inboard (e.g., zone 82-2), a Group B alloy outboard (e.g., zone 80-2), and a Group A alloy in between (e.g., zone 81).

For each of the compositions there may be trace or residual impurity levels of unlisted components or components for which no value is given. For each of the groups, a range may comprise the max and min values of each element across the group with a manufacturing tolerance such as 0.1 wt % or 0.2 wt % at each end. Narrower ranges may be similarly defined to remove any number of outlier compositions from either extreme.

In some further embodiments of Group A, exemplary total Mo+W+Ta+Re+Ru>16 wt %, more particularly >19 wt %. Exemplary Al>5.5 wt %, more particularly 5.6-6.4 wt % or 5.7-6.2%. Exemplary Cr>/=4 wt %, more particularly, >/=5 wt % or 4-7 wt % or 5-7 wt % or 5.0-6.5 wt %.

In some further embodiments of Group B, exemplary total Mo+W+Ta+Re+Ru<10 wt %, more particularly <5 wt %. Exemplary Cr>/=5 wt %, more particularly, >/=6 wt % or 5-10 wt % or 6-9 wt %. Exemplary Al>/=5 wt % more particularly, >/=6 wt % or 6-8 wt % or 6.0-7.0 wt %.

In some further embodiments of Group C, exemplary Cr>/=8 wt %, more particularly >/=10 wt % or 8-13 wt % or 10-13 wt %. Exemplary Ta>/=5 wt %, more particularly 5-13 wt % or 6-12 wt %.

Specific alloys may be chosen to best match characteristics such as common <100> primary orientation, modulus (e.g., within 2%, more broadly 6% or 12%), thermal conductivity (e.g., within 2%, more broadly 3% or 5%, however, a much larger difference (e.g., ~5×) would occur if a nickel aluminide were used as just one of the alloys), thermal expansion (e.g., within 2%, more broadly 6% or 12%).

Figure 4:
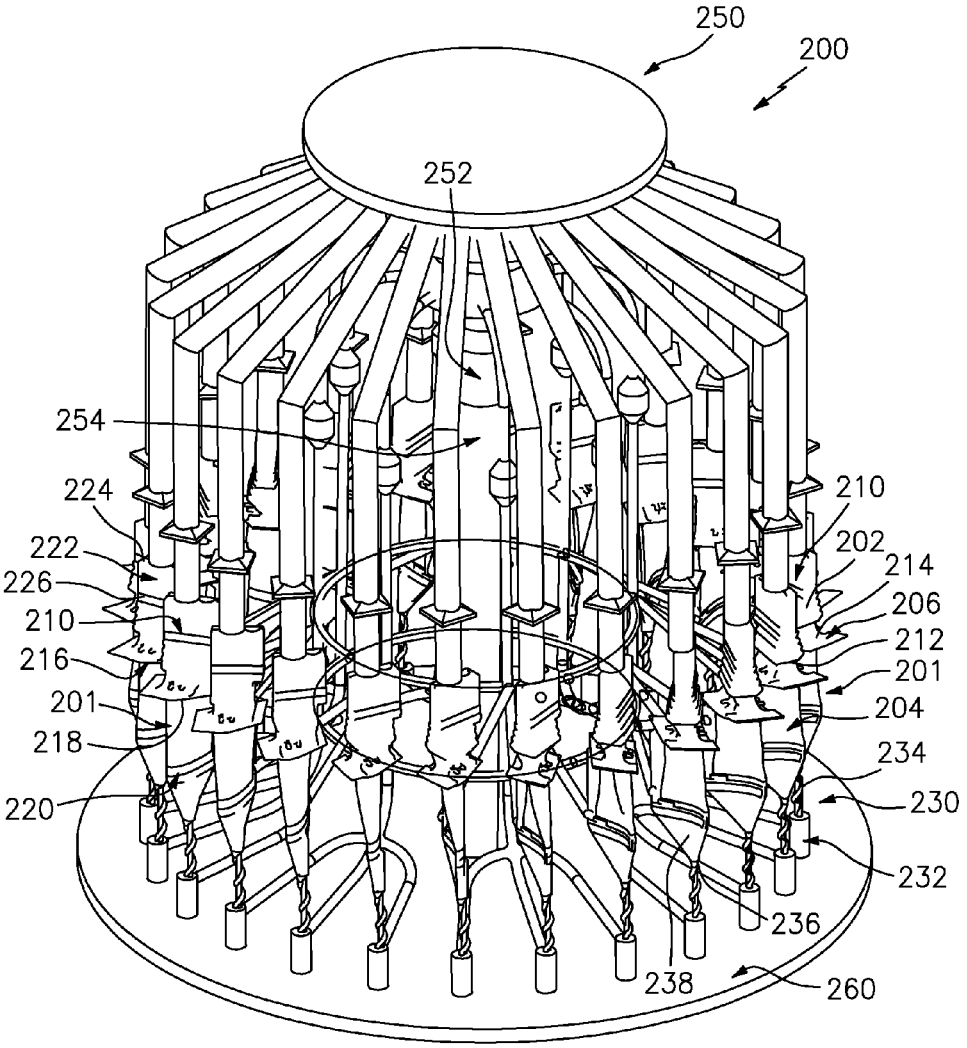
FIG. 4 is a view of pattern assembly for casting blades.

FIG. 4 shows a wax pattern assembly 200 for casting a plurality of multi-alloy blades. In the exemplary pattern, the blade is to be cast in a tip-downward (root-upward) orientation. Alternative orientations are possible. The exemplary pattern assembly 200 comprises a plurality of individual blade patterns 201. Each of the blade patterns 201 includes portions shaped as the corresponding portions of the blade. In the exemplary pattern this includes a root 202, an airfoil 204, and a platform 206. The root portion 202 has a first end 210 orientated upward in this illustration. The second end 212 falls along the underside 214 of the platform. The blade portion 204 extends from an end 216 at the platform outer diameter (OD) surface 218 toward a tip 220. The airfoil has a pressure side, a suction side, a leading edge, and a trailing edge as does the blade airfoil. The root 202 has a fir tree profile as does the blade root. The pattern may be formed by molding a sacrificial pattern material (e.g., wax) over a casting core or core assembly (e.g., ceramic and/or refractory metal core (RMC)) for forming internal passageways in the ultimate blade to be cast. Portions of the core or core assembly may protrude from the wax in order to become embedded in the shell and retained. The pattern further includes a feed portion 222 extending from an upper end 224 to a lower end 226 at the root end 210. The feed portion 222 provides a passageway in the ultimate shell/mold.

The exemplary pattern 201 further includes a grain starter portion 230 having a larger lower portion 232 and a helical portion 234 extending upward therefrom. The helical portion 234 extends to the lower end 236 of a gating portion 238. The gating portion provides a transition between the grain starter and the part to be cast.

For feeding molten metal, the exemplary pattern assembly further comprises a pour cone 250. In the exemplary implementation, the pour cone 250 is preassembled atop a ceramic plug 252. The pour cone 250 may comprise wax with a partially embedded ceramic pour cone insert 251 for forming dual concentric pour cones of the ultimate shell. A mold center post (e.g., formed of wax) 254 extends downward from the plug 252 to the upper surface of a base plate 260. A gripping feature 270 (FIG. 5) extends downwardly from the underside of the base plate for gripping by a robot during a dipping process to shell the pattern assembly (shelling). As so far described, the pattern assembly may be representative of any existing or future pattern assemblies. However, the exemplary pattern assembly includes novel features for forming feed passageways for feeding multiple shots (pours) of metal to the ultimate cavities formed in the shell.

Figure 5:
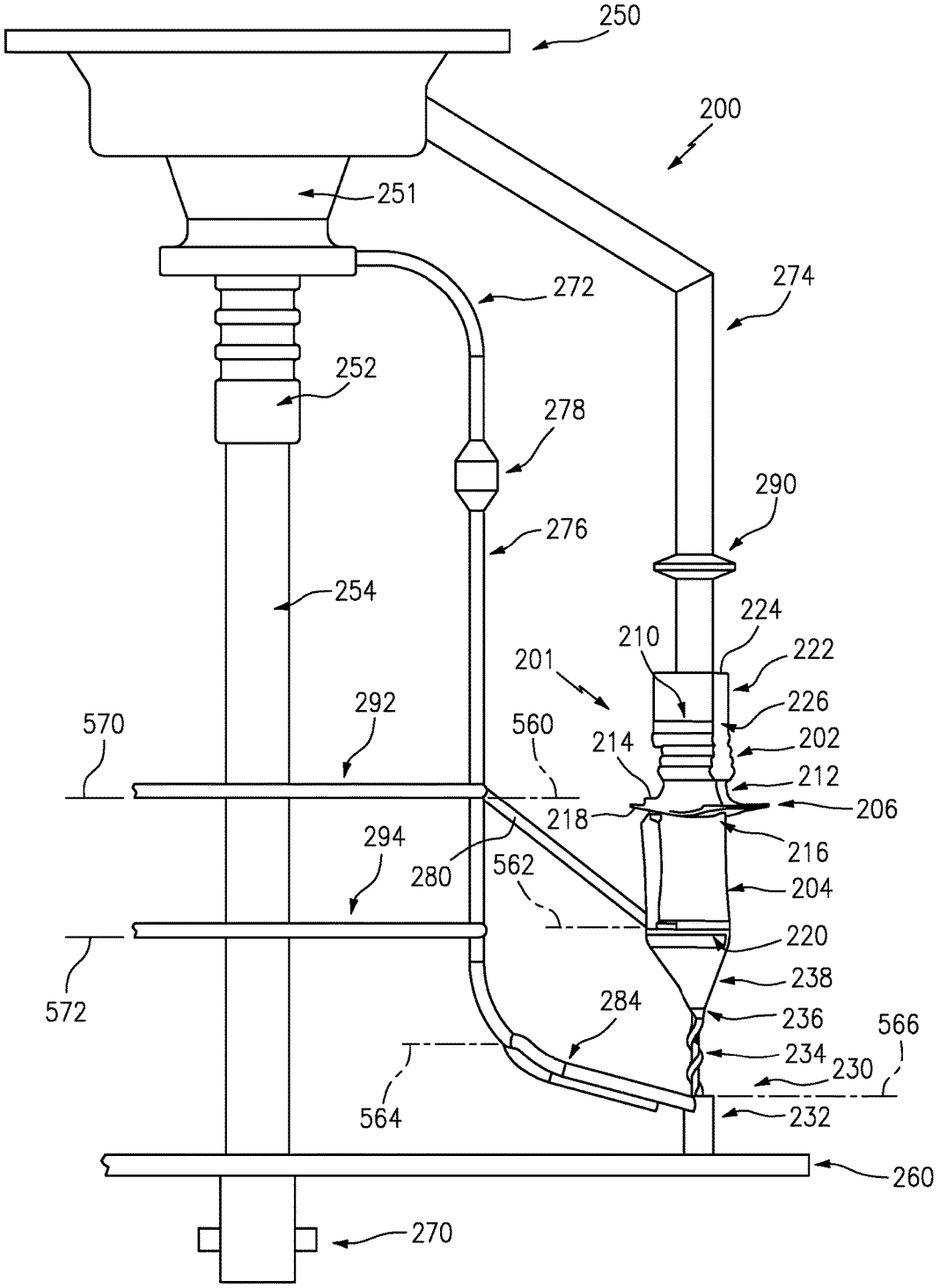
FIG. 5 is a partial side view of an isolated blade pattern in the assembly of FIG. 4.

FIG. 5 shows a first feeder 272 and a riser 274. In the exemplary embodiment, a plurality of each of these are provided with the risers 274 being provided in equal number to the part patterns 201 and the feeders 272 being provided in a denominator of such number. In the exemplary embodiment of FIG. 4, one feeder 272 is provided for each adjacent group of three patterns 201 with respective branches connecting to each pattern 201 in the group. The exemplary feeder includes a main trunk 276 extending downward from an inlet end at a lower end of the pour cone. In the exemplary dual concentric pour cone embodiment, the inlets are along an inner pour cone at least partially formed by the aforementioned insert.

An exemplary in-line filter 278 is located in the feeder trunk. A plurality of upper branches 280 branch off at a vertical location 560 and extend to the associated pattern 201 at a vertical location 562. Exemplary 562 is below 560. A plurality of lower branches 284 branch off from the trunk at a vertical position 564 and meet the grain starters at a vertical position 566. The exemplary riser 274 extends from an intermediate location on the pour cone (the outer pour cone in the dual concentric pour cone embodiment) to the upper end 224 of the feed portion 222. The exemplary feeder 274 includes a geometrical indexing shape 290 to facilitate the precision assembly of thee wax pattern on the mold.

As is discussed further below, to facilitate leveling of the various shots or pours of metal, the pattern includes linking portions 292 and 294 at respective vertical positions 570 and 572.

The ultimate shell passageways formed by these portions 292 and 294 serve to equalize pour levels amongst the various part-forming cavities to provide uniformity.

Figure 6:
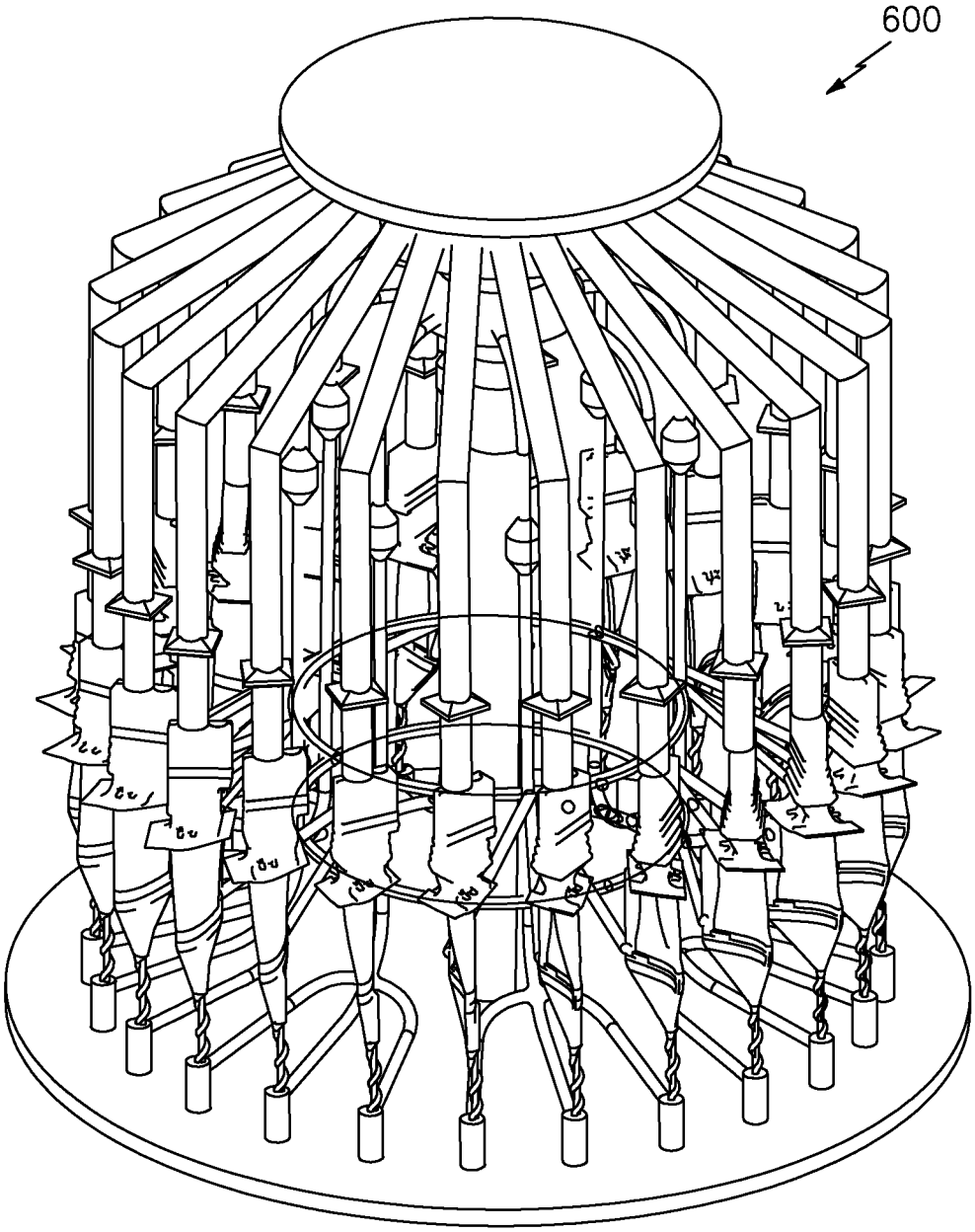
FIG. 6 is a schematic view of passageways in a shell formed by shelling the pattern of FIG. 4.
Figure 7:
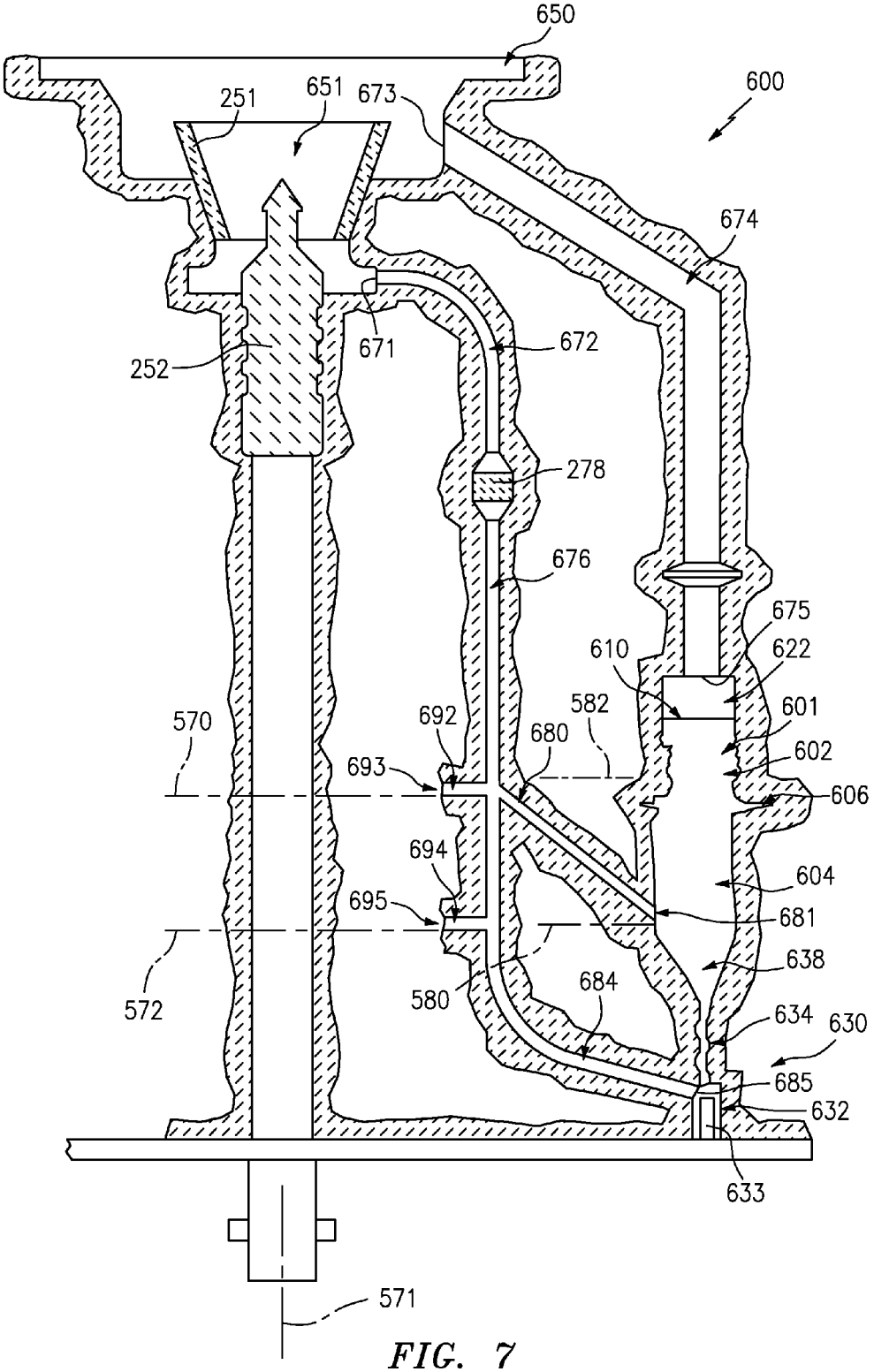
FIG. 7 is an enlarged vertical cutaway view of a blade section of the shell corresponding to the view of FIG. 5.

FIG. 6 schematically shows a representation of the passageways and internal spaces in the resulting shell. This schematic representation is shown by the same form as the passage-forming pieces of the pattern assembly taken from a computer model. FIG. 7 shows shell material over the spaces formed by the pattern (with the pattern viewed in elevation rather than section) and, accordingly, is not a true representation of a section/cutaway.

For ease of reference, the internal passageways of the shell (surrounded by associated shell portions) are numbered with numbers corresponding to the associated features of the pattern assembly 200 but incremented by four hundred. Accordingly, the shell is designated 600, each individual part-forming cavity is designated 601. In the exemplary tip-down blade situation, the cavities include root portion 602, airfoil portion 604, and platform portion 606. A feed portion 622 is above the upper end of the root portion and a gating space 638 is below the airfoil tip. A grain starter portion 630 may include a lower portion 632 containing a seed 633 and a helical portion 634 extending from an upper end 632 to a lower end of the gating portion 638.

The pour cone interior is designated 650 and the respective first and second feed passageways are designated 672 and 674. The feed passageway 672 has a trunk 676 with upper branches 680 and lower branches 684. The upper and lower balancing positions are shown as rings 692 and 694 linking the trunk 676 at the respective vertical positions 570 and 572. The exemplary vertical positions are measured by their lower extremities to more precisely identify the fluid-balancing positions that may be involved. Exemplary rings/passageways 692 and 694 are respectively formed as an array of segments 693 and 695 between adjacent trunks 676.

For casting, the shell is placed in a furnace and heated. During casting, the shell may be downwardly withdrawn from a heating zone of the furnace to allow a bottom-up solidification (the metal solidifying shortly after downwardly exiting the heating zone (e.g., passing a baffle)).

A first shot is poured into the inner pour cone 651. Much of this material is expected to pass through the trunks 676 and their branches 684. However, some may pass through the branches 680 and some may even pass through the feeder 674. The first pour is to a vertical position or height 580 that is at or above the vertical position 572. This allows the passageway 694 to balance the height 580 across the cavities. In the absence of the passageway 694, asymmetries of pour (e.g., the pour is introduced off-center or there are asymmetries of cross-sectional area in the passageways (e.g., even if simply manufacturing tolerances)) may cause the pour level in the individual part-forming cavities 601 to be non-uniform across the different parts. During withdrawal of the shell, at some point the solidification front will intersect the branches 684 and terminate any further flow through these branches. When the solidification front has reached or nearly reached the vertical position 580, the second pour of a second alloy (dissimilar from the first alloy) may be made. The solidification in the branches 684 will prevent any feeding through such branches and thereby, require all feeding to be either through the branches 680 or through the feeder 674. In a similar fashion, the second pour is to a vertical position 582 above the outlet ends of the branches 680 and above the vertical position 570 of the passageway 692 so that the passageway 692 provides a similar equilibrating/leveling role for the second shot or pour as the passageways 694 provided for the first shot or pour. Further relative vertical migration of the solidification front eventually causes the front to reach the branches 680 thereby terminating any further flow through such branches. Assuming there are no further branches off the trunk 676 thereabove, no further flow will pass through the passageways 672. Any further flow must be through the passageways 674.

Accordingly, a third pour may be introduced through the outer pour cone 650 passageways 674 to a level at least above the root end 610. Continued withdrawal ultimately allows the entire filled shell to solidify.

Figure 8:
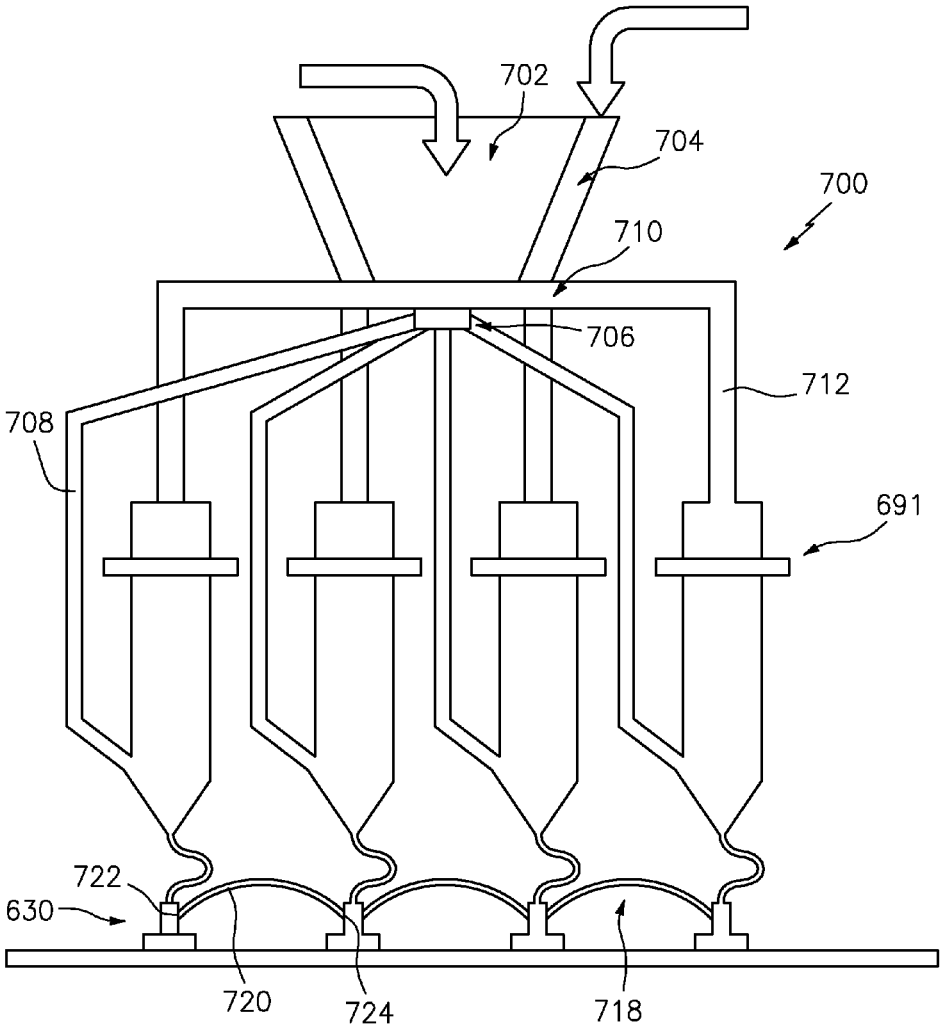
FIG. 8 is schematic view of passageways of a second shell.

FIG. 8 schematically shows an alternative mold cluster 700 with concentric inner 702 and outer 704 pour cones. The inner pour cone is coupled by an associated manifold 706 to passageways 708 similar to the passageways 672 of FIG. 7, while the outer pour cone is coupled by an associated manifold 710 to feed passageways 712 similar to passageways 674 and similarly defining associated flowpaths or sections thereof. A similarly structured mold cluster, wherein one of the two cones is not a pour cone but is rather used for ventilation/upflow of a single shot/pour, is found in U.S. Pat. No. 7,231,955 of Bullied et al. and entitled, "INVESTMENT CASTING MOLD DESIGN AND METHOD FOR INVESTMENT CASTING USING THE SAME" issued Jun. 19, 2007. Shown flattened schematically, the actual part-forming cavities may be arrayed in a circle or the like as are those of the first embodiment.

For equilibrating the first pour, the cluster 700 includes a passageway 718 formed by segments 720 further downstream than the corresponding segments 695 of the passageway 694. In the illustrated example, each segment extends between ends/ports 722 and 724 at the grain starter portions 630 of two adjacent part-forming cavities 601. The exemplary segments 720 are also lower than the segments 695 (although they could be higher (e.g., particularly if directly linking the airfoil-forming portions of the respective part—forming cavities). Accordingly, in this illustrated example, the passageway 718 is in the form of a segmented ring. The segments are shown bowed slightly upward between their ends. This may serve to help ensure the passageways remain at a higher temperature that the cavities in which they are connected since they are further away from the chill plate. This will help facilitate the flow of liquid metal between cavities and help ensure each cavity is filled to the same level. Alternatives may lack such bowing.

In the exemplary shell 700 with a single passageway 718, the first pour is down the passageways 708 and the second pour is down the passageways 712. Other embodiments could add further branches from the passageways 708 and a further linking passageway so as to facilitate intermediate pours.

Alternative embodiments may involve a single pour cone from which all the ports/passageways extend. Yet other variations may have more or fewer pour cones and may have other than concentric pour cones. Other parts and orientations may be cast.

The use of "first", "second", and the like in the following claims is for differentiation only and does not necessarily indicate relative or absolute importance or temporal order. Where a measure is given in English units followed by a parenthetical containing SI or other units, the parenthetical's units are a conversion and should not imply a degree of precision not found in the English units.

One or more embodiments have been described. Nevertheless, it will be understood that various modifications may be made. For example, when applied to modifying a baseline part, or applied using baseline apparatus or modification thereof, details of such baseline may influence details of any particular implementation. Accordingly, other embodiments are within the scope of the following claims.

What is claimed is:

1. A method for casting a plurality of alloy parts in a mold (600; 700) having a plurality of part-forming cavities (601), the method comprising:

pouring a first alloy into the mold causing:

the first alloy to branch into respective flows along respective first flowpaths (676, 684; 708) to the respective cavities; and a surface of the first alloy in the part-forming cavities to equilibrate via a first passageway (694; 718) linking the first flowpaths; and pouring a second alloy into the mold causing:

the second alloy to branch into respective flows along respective second flowpaths (676, 680; 712) to the respective cavities.

2. The method of claim 1 wherein:

the first passageway comprises a plurality of segments (695) each directly connected to a pair of downsprues.

3. The method of claim 1 wherein:

the first passageway comprises a plurality of segments (720) each directly connected to a pair of grain starters.

4. The method of claim 1 wherein:

said pouring said second alloy into the mold causes a surface of the second alloy in the part-forming cavities to equilibrate via a second passageway (692) linking the second flowpaths.

5. The method of claim 1 wherein:

the first flowpaths and second flowpaths extend from a single pour cone.

6. The method of claim 5 wherein:

each of the first flowpaths is partially overlapping with an associated one of the second flowpaths.

7. The method of claim 1 wherein:

after the equilibrating of the first alloy, but before the pouring of the second alloy, the first alloy along at least portions of the first flowpaths solidifies.

8. The method of claim 1 wherein:

the first alloy and the second alloy are of different composition.

9. The method of claim 1 further comprising:

pouring a third alloy into the mold.

10. The method of claim 1 wherein:

the first flowpaths and second flowpaths extend from first ports on a pour cone; and third flowpaths extend from second ports on the pour cone.

11. The method of claim 10 wherein:

the pour cone is a dual concentric pour cone having an inner pour cone and an outer pour cone;

the first ports are on one of the inner pour cone and the outer pour cone; and the second ports are on the other of the inner pour cone and outer pour cone.

12. The method of claim 1 wherein:

the alloy parts are turbine engine blades.

13. The method of claim 1 wherein:

the first alloy and the second alloy are nickel- and/or cobalt-based superalloys.

14. A casting mold (600; 700) comprising:

a plurality of part-forming cavities (601), each having a lower end and an upper end;

a pour cone;

a plurality of first feeder passageway sections (684; 708) extending to associated first ports (685) on respective associated said cavities;

a first passageway (694; 718) connecting the part forming cavities at a height below tops of the part-forming cavities; and a plurality of second feeder passageway sections (680; 712) extending to associated second ports (681) on respective associated said cavities, the second ports being higher than the first ports.

15. The casting mold of claim 14 further comprising:

the first passageway (694) connects the part forming cavities via the first feeder passageway sections.

16. The casting mold of claim 14 further comprising:

a second passageway (692) connecting the second feeder passageway sections.

17. The casting mold of claim 16 wherein:

the first feeder passageway sections and the second feeder passageway sections branch from trunk passageway sections (676) extending downward from the pour cone.

18. The casting mold of claim 16 wherein:

the first passageway is below the second passageway.

19. The casting mold of claim 14 further comprising:

a plurality of third feeder passageway sections (674) extending to associated third ports (675) on respective associated said cavities.

20. The casting mold of claim 19 wherein:

the third ports (675) are above the second ports (681).

21. The casting mold of claim 19 further comprising:

first flowpaths through the first feeder passageway sections to the first ports and second flowpaths through the second feeder passageway sections to the second ports extend from a first ports (671) on the pour cone; and third flowpaths through the third feeder passageway sections to the third ports extend from second ports (673) on the pour cone.

22. The casting mold of claim 14 wherein:

a first passageway comprising the first feeder passageway sections and a second passageway comprising the second feeder passageway sections extend fully around a central vertical axis (571) of the mold.

23. The casting mold of claim 14 wherein:

there are 3-40 said cavities.

24. The casting mold of claim 14 wherein:

the cavities are blade-shaped.

25. The casting mold of claim 14 wherein one or both:

the cavities have seeds (633); and the cavities comprise helical grain starter passageways (634).

* * * * *